US005321936A

United States Patent [19]

Sendldorfer

[11] Patent Number: 5,321,936

[45] Date of Patent: Jun. 21, 1994

[54] METHOD AND APPARATUS FOR FOLDING CARTONS TO CONSISTENTLY SQUARE THE CARTONS

[76] Inventor: Joseph Sendldorfer, 6104 Fairwood Ave., Baltimore, Md. 21206

[21] Appl. No.: 955,797

[22] Filed: Oct. 5, 1992

[51] Int. Cl.[5] ..... B65B 7/20; B65B 7/26

[52] U.S. Cl. ..... 53/491; 53/376.4

[58] Field of Search ..... 53/491, 376.4, 377.2, 53/377.6, 376.5, 378.3

[56] References Cited

U.S. PATENT DOCUMENTS

| | | | |
|---|---|---|---|
| 2,768,492 | 10/1956 | Kay et al. | 53/377.2 |
| 3,726,061 | 4/1973 | Pagdin et al. | 53/377.2 X |
| 3,959,950 | 6/1976 | Fukuda | 53/377.2 X |
| 4,196,563 | 4/1980 | Gabrielson et al. | 53/377.2 X |
| 4,218,862 | 8/1980 | Marchetti | 53/377.2 |

*Primary Examiner*—Horace M. Culver

[57] ABSTRACT

A method and apparatus for folding the major flaps of cartons uses a folding rail having entry, transitional and exit sections which include vertical, curvilinear and horizontal surfaces, respectively, such that the transitional and exit sections are machined from a solid block of metal to have a curvilinear surface of a particular curvature developed from three-dimensional modelling on a computer aided design system in order to consistently square the cartons in a folding operation. The folding rails are positioned in a flap closure station such that a leading folding rail is mounted on a stationary mounting block and a trailing folding rail is mounted on a translatable folding rail in order for the folding rails to be moved closer together or farther apart to fold cartons of different widths. The folding rails have guide rails mounted to them to guide the folded cartons into a compression finger assembly where an arrangement of easily replaceable teflon rails is used to compress the flaps of the cartons to spread the glue. The compression finger assembly is followed by a transport rail assembly of teflon rails which provide a smooth, nonabrasive surface for the cartons to slide along in order for the cartons to set.

32 Claims, 6 Drawing Sheets

METHOD AND APPARATUS FOR FOLDING CARTONS TO CONSISTENTLY SQUARE THE CARTONS

FIELD OF THE INVENTION

The present invention relates generally to a method and apparatus for folding cartons and, more particularly, to a method and apparatus for folding cartons using folding rails machined from a solid block of metal to have a curvilinear surface which consistently squares the cartons.

BACKGROUND OF THE INVENTION

Many industries today produce products which require packaging. This is especially true in industries such as the powdered soap detergent manufacturing industry where the product produced would be rather hard to sell without being packaged. With the packaging being such an integral part of selling the product, industrial packaging operations have evolved in order to better package products and to handle packaging on a mass-production scale. The industrial packaging operations which have evolved, however, have not been perfected and are plagued with problems due to 1) product proliferation and diversification which requires quickly changeable equipment to handle a myriad of different package sizes and 2) the need to ever more efficiently and cost effectively containerize the product in order to remain competitive.

Folded cartons have emerged as one of the most efficient ways to package certain products. Carton folding apparatus has developed which uses a combination of folding rails, compression fingers and transport rails to fold, close and seal the flaps of scored cartons in order to containerize a product. The folding rails, compression fingers and transport rails are positioned within a flap closure station so that the folding rails fold the glued flaps of the cartons, the compression fingers compress the cartons to spread the glue and the transport rails provide a smooth, non-abrasive surface along which the carton can slide to further spread the glue while at the same time allowing the glue to dry so that the carton may set. Unfortunately, conventional folding rails, compression fingers and transport rails do not always function as designed and numerous problems have become associated with carton folding operations.

A major problem associated with conventional carton folding apparatus is that the folding rails do not consistently square the cartons. Folding rails are old and well known in the art and come in a variety of shapes and sizes. However, current carton folding operations generally include folding rails that are bent from metal bars or strips in order to have a vertical section, a horizontal section and a transitional section between the vertical and horizontal section. The folding rails bent from metal bars or strips do not consistently fold and square cartons because the transitional sections of the folding rails are not bent to any particular or predetermined curvature, but rather to whatever curvature is attained in arriving at the vertical and horizontal sections.

Thus, folding rails that are bent from metal bars or strips often introduce too much stress into the folding process to cause a skewing of the cartons. Stated another way, when a carton having major and minor flaps is conveyed through a conventional carton folding operation using folding rails bent from metal bars or strips to fold and close the cartons, the folding rails do not consistently fold the flaps so that the cartons are in true square. With many industries today having quality control standards that require cartons out of true square by more than 1/32 of an inch to be rejected, often over 5% of folded cartons fail to meet industry standards. This makes it hard for industry to meet its production quotas and results in waste of both finished cartons and time and money spent on costly, time-consuming trial and error attempts to rebend the transitional sections of the folding rails to a curvature producing acceptably squared cartons.

Another problem associated with conventional folding rails is the lack of adjustability and interchangeability between rail sizes for folding cartons of varying sizes. Conventional folding rails are designed in a sort of one size fits all mentality to fold a limited range of carton sizes and to fold either full-size flaps or shied flaps, i.e., inner and outer major flaps of a carton that are not the full size of the carton opening and thus do not fully overlap each other. Thus, excessive down time is created when the folding rails need to be changed to folding rails of another size to accommodate folding cartons in other size ranges or to accommodate folding shied flaps. Indeed, it often takes a skilled technician as much as 8 to 12 hours to reposition or change-over the heavy stainless steel rails currently used in conventional carton folding apparatus in order to fold cartons of a different size. During the down time, the plant is not in operation and money is being lost.

Conventional folding rails also suffer from problems of incorrect feeding and jamming of the cartons at the folding rail. If a carton is fed incorrectly through a conventional carton folding apparatus, whether because of hot glue build-up on a carton flap, incorrect height of the transport rails or otherwise, a jam at the folding rail will occur and the folding rails will become deformed. A mechanic is then usually required to spend numerous hours, sometimes days, of trial and error in rebending the rails and performing trial runs to get acceptably folded cartons. Thus, in addition to the excessive down time such a process requires, hundreds of finished cartons are often wasted too.

Carton scuffing, discoloration lines and scratches are additional problems often associated with conventional carton folding apparatus. Cartons today are often made from a combination of plastic and cardboard applied in layers to form a laminate, e.g., outside film laminate (OFL) or inside film laminate (IFL). The outside surfaces of the laminates are often damaged by the stainless steel folding rails of conventional cart on folding apparatus which acts like sandpaper and abrades the cartons.

Another problem plaguing conventional carton folding operations is the excessive down time currently required to replace teflon rails. Teflon rails must be replaced when worn or when glue builds-up on the rails. Conventional teflon rails are made entirely of costly virgin teflon and are arranged so that a set of rails are bolted together by drilling holes through each of the rails in the set at various locations in order to insert bolts through the holes to thus, connect the rails together in series. Replacement of teflon rails so bolted together is costly and time consuming because of the need to disassemble the whole assembly and to drill holes in the new rails to be placed in the teflon rail arrangements.

Current industrial carton folding operations are also experiencing difficulties with respect to excessive glue consumption. Hot glues of high viscosity are typically used and are very expensive. Folding rails shapes, line speed and glue open time are all parameters affecting the amount of glue consumed. Thus, methods and apparatus which function more efficiently to fold and compress cartons would reduce glue consumption and save money.

A need exists, therefore, for improved methods and apparatus for folding cartons using folding rails having a curvilinear surface of a predetermined curvature to consistently produce squared cartons, which are adjustable and interchangeable to reduce excessive down time by allowing for quick and easy changeover to different rail sizes for folding cartons of varying sizes, widths and flaps, i.e. full-size versus shied or to replace deformed rails, which are durable, of low maintenance and of simple installation and which use teflon rail arrangements designed to be quickly and easily replaced in order to decrease the down time and expense associated with conventional teflon rails.

SUMMARY OF THE INVENTION

The present invention provides a method and apparatus for folding the major flaps of cartons using folding rails machined from a solid block of metal to have a curvilinear surface shaped to consistently square the cartons and positioned in opposed and offsetting relationship on one stationary and one translatable mounting block to quickly and easily adjust to folding cartons of different widths, sizes and flap types, i.e., full-size or shied. The folding rail have a entry portion with a vertical surface, an exit portion with a horizontal surface, and a transitional portion with a curvilinear surface between the entry and exit portions such that the curvilinear surface is characterized by a shape approximating the shape of a rectangle having vertical short side walls and horizontal long side walls twisted through a 90° angle so that one of the vertical short side walls becomes contained in a horizontal plane after twisting. The shape of the curvilinear surface serves to more consistently square the cartons such that the exact curvature of the curvilinear surface is determined through the use of three dimensional modeling on a computer-aided design system in order to machine the solid block on a computer numerically controlled machinery center from data generated directly from the three-dimensional model.

DETAILED DESCRIPTION OF THE INVENTION

Figure 1:
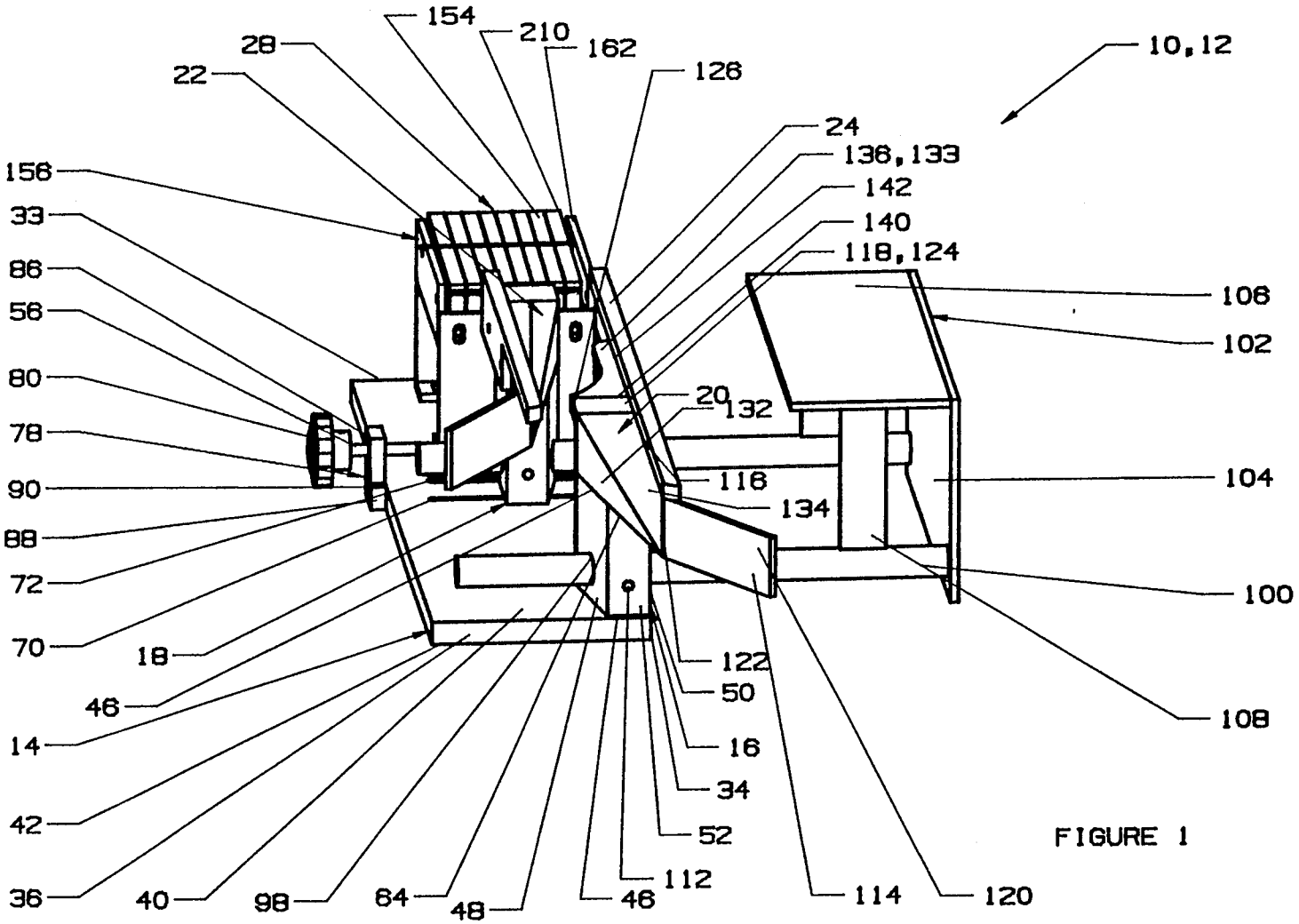
FIG. 1 is a perspective view of the carton folding apparatus of the present invention.
Figure 2:
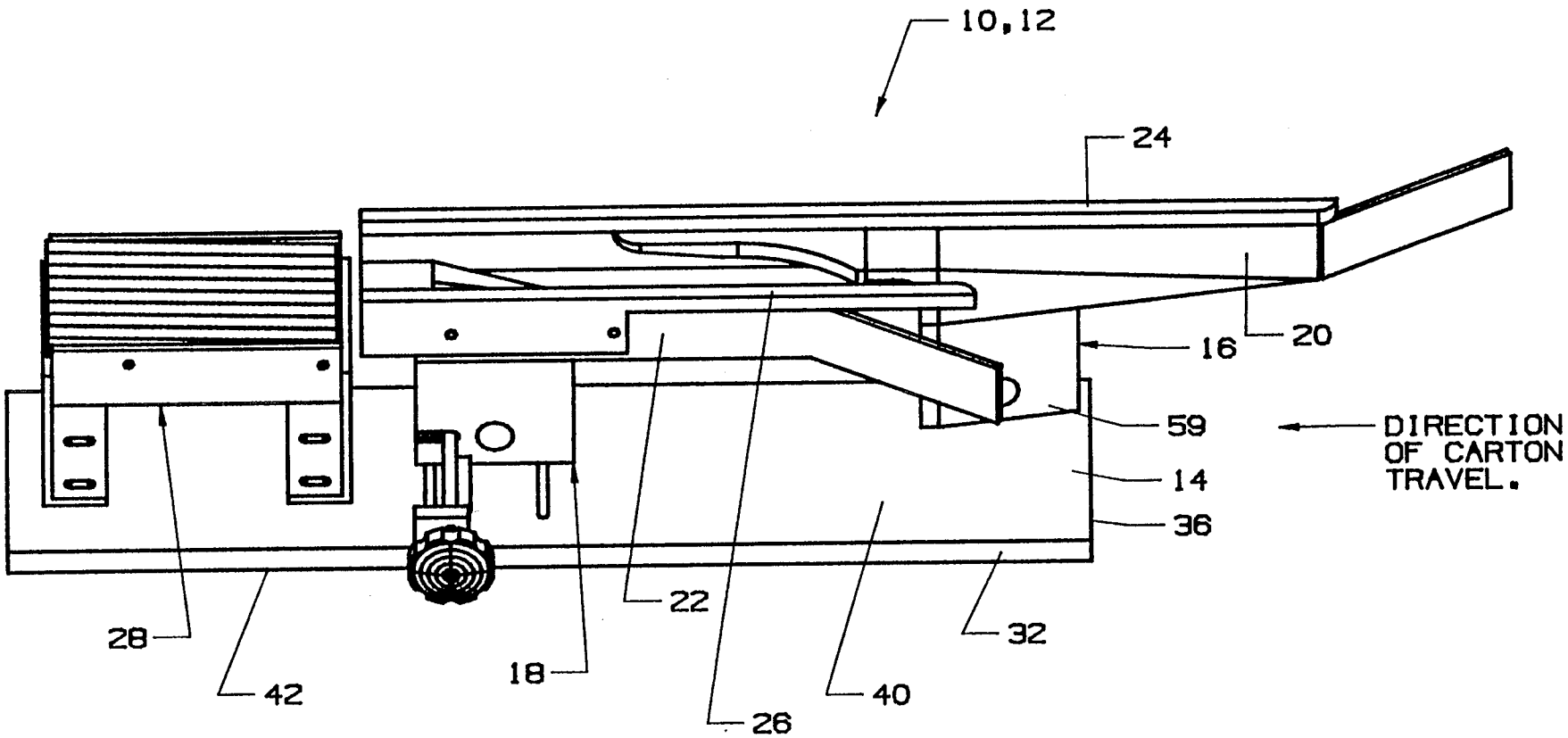
FIG. 2 is a perspective view of the carton folding apparatus from another angle.
Figure 3:
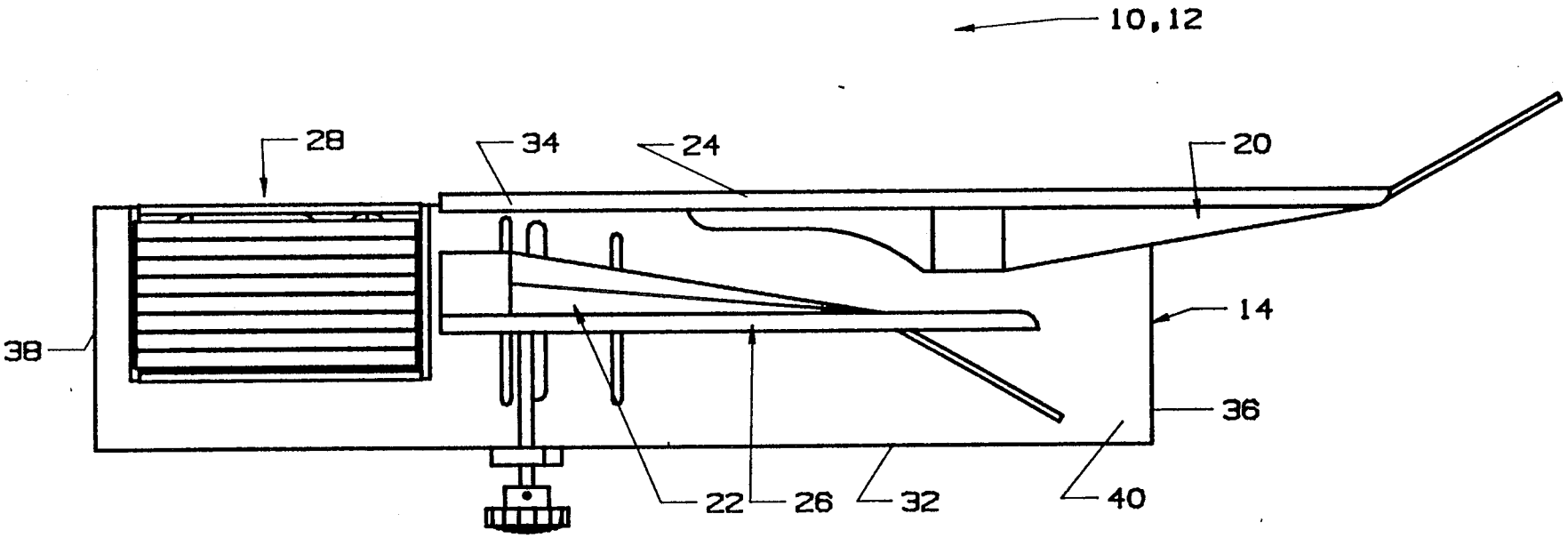
FIG. 3 is a top plan view of the carton folding apparatus.
Figure 4:
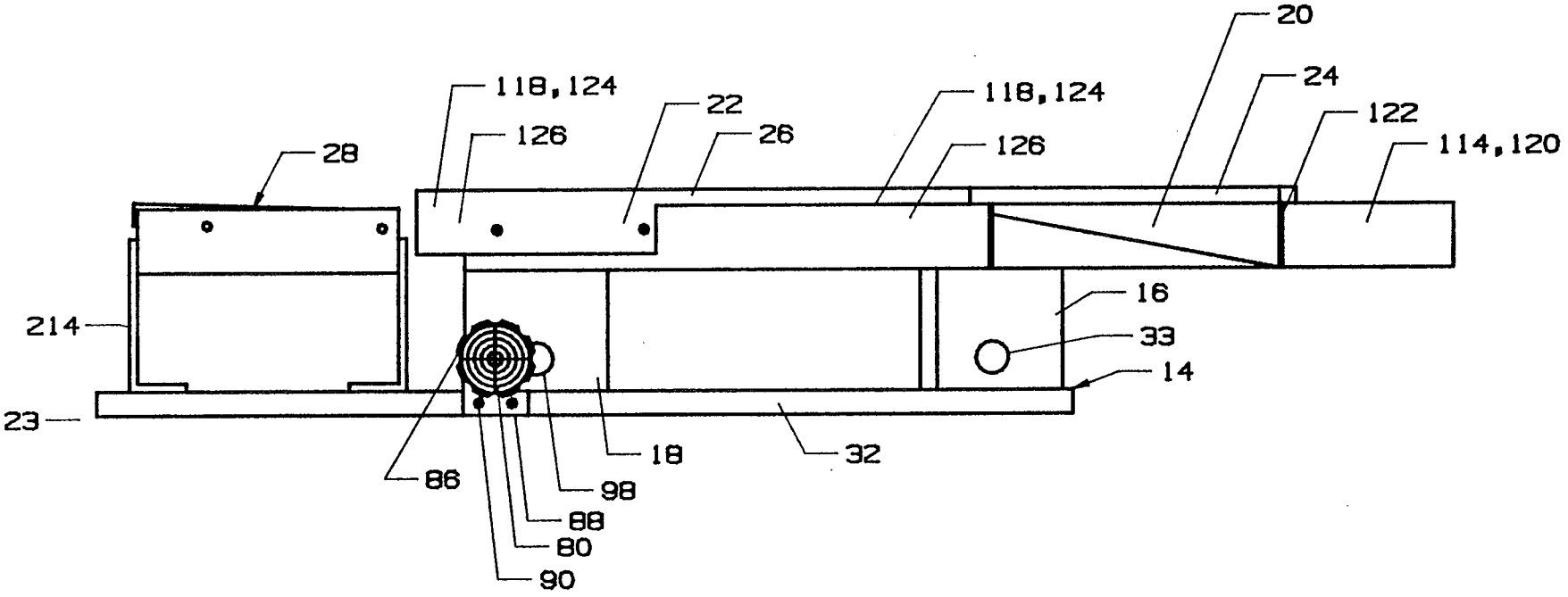
FIG. 4 is a left side elevational view of the carton folding apparatus.
Figure 5:
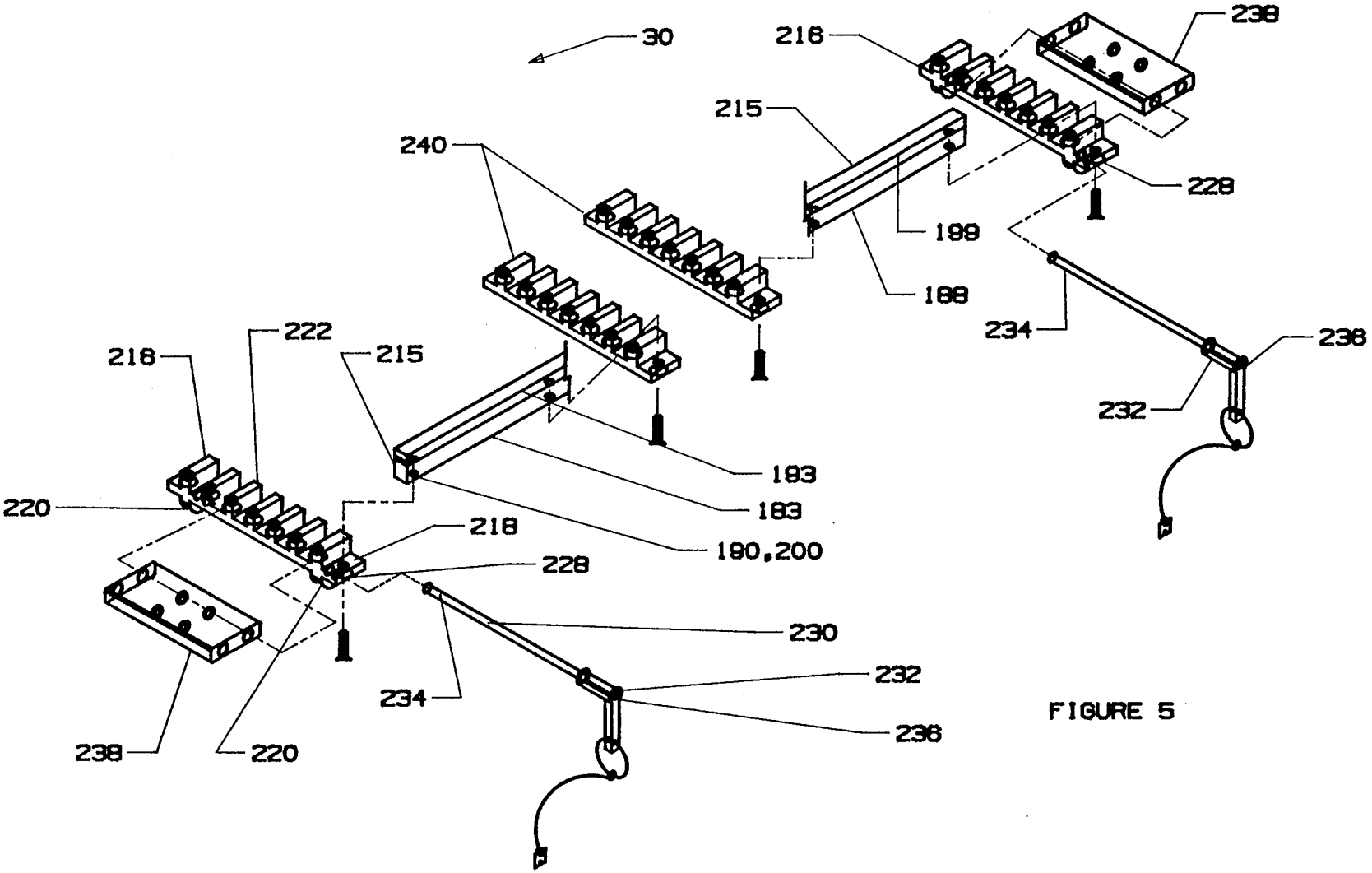
FIG. 5 is an exploded perspective view of the assembly of a transport rail arrangement.
Figure 6:
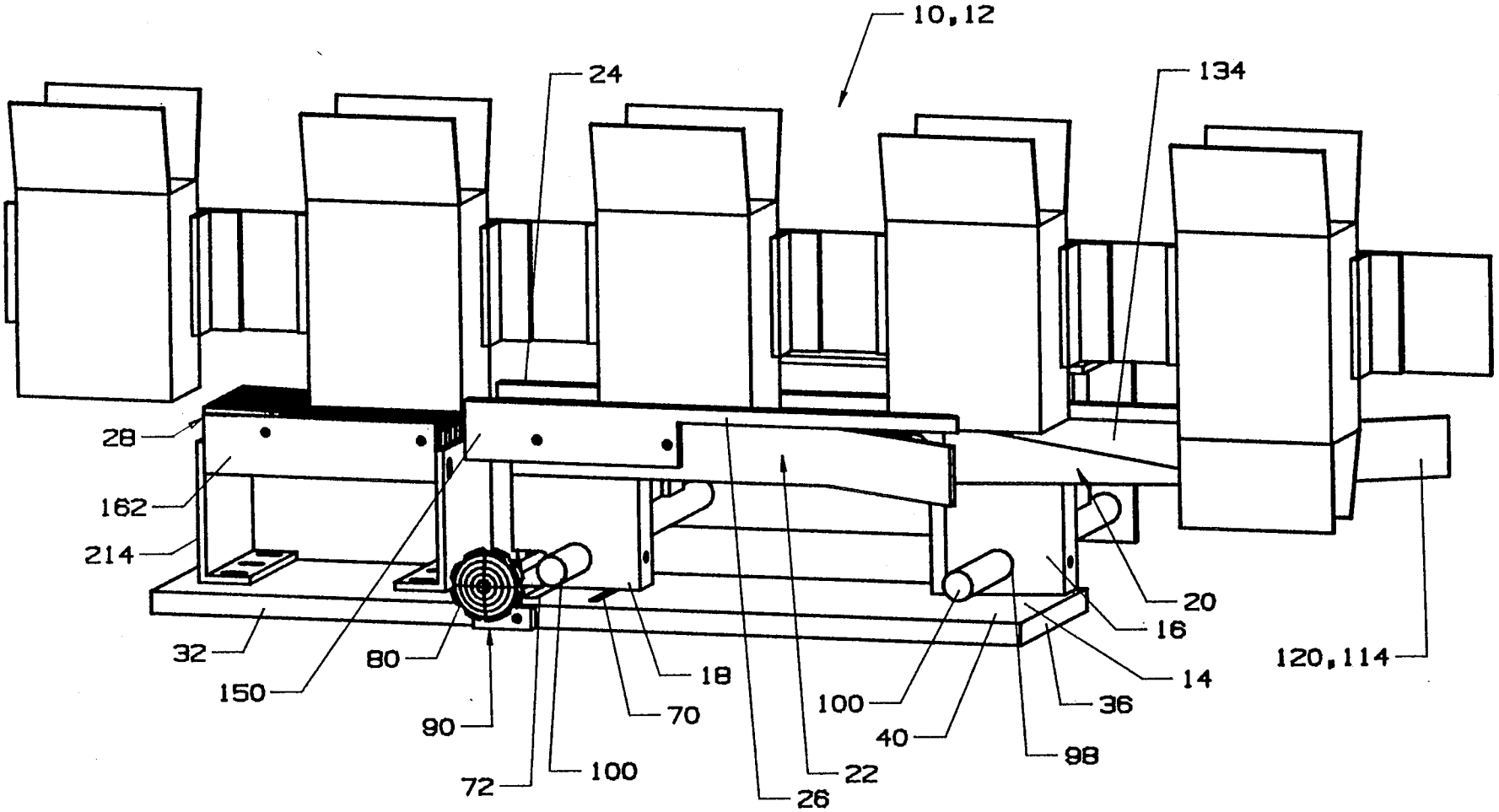
FIG. 6 is a perspective view of the carton folding apparatus showing cartons being transported through a flap closure station.

Referring to FIG. 1, in a preferred embodiment of the present invention, apparatus 10 for folding, closing and sealing the flaps of scored cartons to more consistently square the cartons in a packaging operation is shown. More particularly, FIG. 1 shows a flap closure station 12, which may be either a top flap closure station, for folding and sealing the glued, top, inner and outer major flaps located at the bottom of an upside-down, unloaded carton, or a bottom flap closure station, for folding the glued, bottom, inner and outer major flaps located at the top of an upside-down, loaded carton. Thus, top and bottom flap closure stations have exactly the same structure and the designation as to top or bottom flap closure station depends only upon the orientation of the flap closure station, i.e., whether the flap closure station is positioned to rest on top of a support structure as viewed in FIG. 1, or is positioned to hang inverted from a support structure in a packaging operation.

Flap closure station 12 includes a base 14, a pair of riser blocks 16, 18, a pair of opposed and offset folding rails 20, 22, a pair of guide rails 24, 26, a compression finger assembly 28 and a transport rail assembly 30.

In a preferred embodiment of the invention, base 14 is a rectangular aluminum plate having rectangular left and right edge surfaces 32, 34, rectangular front and back edge surfaces 36, 38, and rectangular top and bottom surfaces 40, 42. The rectangular front and back and left and right edge surfaces 32, 34, 36, 38 are approximately vertical and the rectangular top and bottom surfaces 40, 42 are approximately horizontal when the base 14 is mounted in use in a packaging operation. Although a rectangular metal plate is used in the preferred embodiment, a base 14 of any size, shape and material suitable for use in a packaging operation may be used without departing from the spirit and scope of the invention.

A pair of riser blocks 16, 18 are mounted to base 14. The riser blocks 16, 18, of the preferred embodiment, are solid aluminum blocks having a cross-section in the shape of a truncated right triangle. This shape corresponds to the shape of the bottom surface of the folding rails 20, 22 for ease of mounting of the folding rails 20, 22 on the riser blocks 16, 18, however, riser blocks 16, 18 of any suitable size, shape and material may be used. The riser blocks 16, 18 have truncated triangular shaped top and bottom surfaces 44, 46, rectangular inner and outer side surfaces 48, 50, and rectangular leading and trailing end surfaces 52, 54 with the rectangular leading end surface 52 being of a smaller area than the rectangular trailing end surface 54.

When the riser blocks 16, 18 are mounted on base 14 in use, the six surfaces of riser blocks 16, 18 are oriented as follows. The truncated triangular top and bottom surfaces 44, 46 of the riser blocks 16, 18 are approximately horizontal and the bottom surfaces 46 of the riser blocks 16, 18 are in contact with the top surface 40 of the base 14. The rectangular leading and trailing end surfaces 52, 54 are approximately vertical and are positioned approximately parallel with the front and back edge surfaces 36, 38 of the base 14 and approximately perpendicular to the top surface 40 of the base 14. The rectangular inner and outer side surfaces 48, 50 are approximately vertical with the outer side surface 50 being approximately parallel to the left and right edge surfaces 32, 34 of the base 14 and approximately perpendicular to the top surface 40 of the base 14 and the inner side surface 48 being inclined at an angle to the left and right edge surfaces 32, 34 of the base 14 and approximately perpendicular to the top surface 40 of the base 14.

The riser blocks 16, 18 are mounted to the base 14 using an arrangement of all-thread screws 56, apertures 58, and threaded nuts 60 in order for riser block 16 to be stationarily mounted to the front end of base 14 and riser block 18 to be translatably mounted near or slightly behind the lengthwise center of base 14 for back and forth translation of the riser block 18 across the width of the base 14. In a preferred embodiment, circular apertures 58 are drilled through the top surface at the four corners of each riser block 16, 18 so that the circular apertures 58 extend cylindrically through the riser blocks 16, 18 from the top surface 44 to the bottom surface 46 to pierce the riser blocks 16, 18.

All-thread screws 56 are inserted through each aperture 58 in each riser block 16, 18 such that portions of the all-threads 56 extend past both the top and bottom surfaces 44, 46 of the riser blocks 16, 18. The portions of the all-threads 56 extending past the top surfaces 44 of the riser blocks 16, 18 screw into threaded apertures 62 through the bottom surfaces 64 of the folding rails 20, 22 to attach the riser blocks 16, 18 to the folding rails 20, 22. The portions of the all-threads 56 extending past the bottom surfaces 46 of the riser blocks 16, 18 screw into threaded apertures 66 through the thickness of the base 14 to attach the riser blocks 16, 18 to the base 14. The portions of the all-threads 56 that screw into the threaded apertures 66 drilled through the thickness of the base 14 are designed to protrude past the bottom surface 42 of the base 14 in order for the all-thread screws 56 to accept washers 68 and threaded nuts 60 and thus, secure the connection of the riser blocks 16, 18 to the base 14.

Stationary riser block 16 is mounted to the front end of the base 14 so that the outer side surface 50 of the riser block 16 is aligned coextensively with a right or left edge surface 32, 34 of the base 14. Translatable riser block 18 is mounted near or slightly behind the lengthwise center of the base 14 in a manner similar to the mounting of stationary riser block 16, except that the apertures in the base 14 through which the all-threads 56 are inserted are long oval shaped apertures 70 that extend almost the full width of the base 14 in order to allow for back and forth translation of the riser block 18 with its attached folding rail 22 and thus, accommodate different carton widths in the flap closure station 12.

Translatable riser block 18 further has a groove 72 of rectangular cross section through the bottom surface 46 of the riser block 18 extending transverse to the outer side surface 50 from the outer side surface 50 to the inner side surface 48 of the riser block 18 at a location between the drilled circular apertures 58 at the corners of the riser block 18. The groove 72 houses approximately an upper half of a small rectangular metal block 74 while the approximate bottom half of the small rectangular metal block 74 is housed in a long oval groove 76 through the top surface 40 of the base 14 located between the long oval apertures 68 and like the oval apertures 70 extending almost the width of the base 14. This groove 72, 76 and block 74 arrangement aids in the translation back and forth of riser block 18 across the width of the base 14.

The translation of the riser block 18 is accomplished using an arrangement of an L-shaped adjustor bracket 78, an all-thread screw 56, an adjustor knob 80, a groove 82, and a threaded nut 60. The L-shaped bracket 78 is attached to left or right edge surface 32, 34 of the base 14 in such a way that the bottom 84 of the bracket 78 is aligned coextensively with the bottom surface 42 of the base 14 with one leg 86 of the L-shaped bracket 78 extending vertically past the top surface 40 of the base 14 and the other leg 88 of the L-shaped bracket 78 extending horizontally along a left or right edge surface 32, 34 of the base 14. The horizontally extending leg 88 of the L-shaped bracket 78 has two threaded holes 90 drilled through the thickness of the bracket 78 in order for all-thread screws 56 to be screwed through the holes 90 in the bracket 78 and into threaded apertures 92 drilled into the left or right edge surfaces 32, 34 of the base 14 to attach the L-shaped bracket 78 to the base 14. The vertically extending leg 86 of the L-shaped bracket 78 has one threaded hole 94 drilled through the thickness of the bracket 78 in order for an all-thread screw 56 to be screwed through the hole 92 and into a threaded nut 60 slid sideways into groove 96 cut into the outer side surface 50 of the translatable riser block 18 in order to effect the translation of the riser block 18 via an adjustor knob 80 attached to the all-thread screw 56 on the other side of the L-shaped bracket 78. The groove 96 is U-shaped at the surface of outer side surface 50 and for some thickness transverse to the outer side surface 50, however, the U-shaped groove 96 connects to a second section of larger rectangular cross-section which is machined through the rectangular trailing end surface 54 transverse to the rectangular trailing end surface and in back of the U-shaped section of the groove 96. A groove 96 thus configured is capable of housing a threaded nut 60 by sliding the nut 60 sideways into the larger rectangular back section of the groove 96. In this way, the threaded nut 60 can accept an end of an all-thread screw 56 with the other end of the all-thread screw 56 threaded into the adjustor knob 80.

Thus, translation of the riser block 18 toward riser block 16 is accomplished by twisting the adjustor knob 80 clockwise. The clockwise turning of the adjustor knob 80 extends the all-thread screw 56 connected to the adjustor knob 80 farther through the aperture 92 in the vertical leg 86 of the L-shaped bracket 78 so that the end of the all-thread screw 56 threaded into the threaded nut 60 contained in the groove 96 in the riser block 18 extends farther in the direction of the riser block 16 and translates the riser block 18 closer to riser block 16.

Translation of the riser block 18 away from riser block 16 is accomplished by twisting the adjuster knob 80 counter-clockwise. The counterclockwise turning of the adjustor knob 80 retracts the all-thread screw 56 connected to the adjustor knob 80 through the aperture 92 in the vertical leg 86 of the L-shaped bracket 78 so that the end of the all-thread screw 56 threaded into the threaded nut 60 contained in the groove 96 in the riser block 18 does not extend as far in the direction of the riser block 16 and translates the riser block 18 farther away from riser block 16.

The riser blocks 16, 18 each have a cylindrical aperture 98 of approximately 1-inch in diameter extending through the riser blocks 16, 18 transverse to the outer side surface 50 from the outer side surface 50 to the inner side surface 48 of the riser blocks 16, 18. The cylindrical aperture 98 in each riser block 16, 18 is for slidable insertion of the shafts 100 of a universal bracket 102, where the universal bracket 102 is attached to a support in a packaging operation in order to effect quick and easy change-over to different size folding rails.

The universal bracket 102 includes two cylindrical shafts 100, a large and small rectangular plate 104, 106 and two rectangular supports 108. The two rectangular plates 104, 106 are welded together to form an L-shaped bracket such that when mounted for use in a packaging operation the large rectangular plate 104 is approximately vertical and the small rectangular plate 106 is approximately horizontal. A cylindrical shaft 100 is welded to the corners of the large rectangular plate 104 located opposite the edge of the large rectangular plate 104 welded to the small rectangular plate 106 so that the small rectangular plate 106 extends over and in the same direction as the cylindrical shafts 100. A rectangular support 108 is size to fit between the bottom rectangular surface 106 of the small rectangular plate 106 and the cylindrical shaft 100 in order to weld the support 108 to the shaft 100 and the plate 106 at the corners of the plate 106 located opposite the edge of the small rectangular plate 106 welded to the large rectangular plate 104. A universal bracket 102 has holes through the small rectangular plate 106 in order to bolt the plate 106 to a support in a packaging operation in order to quickly and easily change the folding rails 20, 22 via sliding of the riser block aperture 98 on and off the universal bracket's shafts 100.

The shafts 100 of the universal bracket 102 have the added feature of machined flats on the rounded surfaces of the shafts 100 that face closest the rectangular leading end surfaces 52, 54 of the riser blocks 16, 18 when the shafts 100 are inserted in the apertures of the riser blocks 16, 18. Circular threaded apertures 112 are drilled approximately perpendicular to the rectangular leading surfaces 54 of the riser blocks 16, 18 through the rectangular leading end surfaces 54 of riser blocks 16, 18 to the approximately 1-inch diameter apertures 98 for slidable insertion of the shafts 100. All-thread screws 56 may then be threaded into the apertures 112 for an end of the all-thread screws 56 to rest against the flat of the shafts 100 to hold the shafts 100 against the walls of the approximately 1-inch diameter aperture 98.

Folding rails 20, 22 each have a unique shape which includes an entry section 114, a transitional section 116, and an exit section 118. The entry sections 114 are flat rectangular metal plates which are preferably aluminum, although any suitable metal may be used. The flat rectangular plates have rectangular surfaces 120 that are vertically oriented for contacting a carton's major flaps when the folding rails 20, 22 are mounted in use. The rectangular surfaces 120 act to guide a carton's major flaps which are oriented at an approximately 45 degree angle into vertical orientations in preparedness for the flaps to contact the transitional sections 116 of the folding rails 20 22. The plates intersects the transitional sections 116 at approximately vertical edges 122 where the plates are welded to the transitional sections 116 at an angle back from the longitudinal axes of the folding rails 20, 22. A triangular support plate is welded to the back rectangular surface of the entry section 114 and the back rectangular surface 128 of the transitional section 116. The support plate is positioned perpendicular to both back rectangular surfaces in order to provide support for the entry section's rectangular plate at its vertically welded attachment to the transitional section 116.

The transitional and exit sections 116, 118 of the folding rails 20, 22 are machined from rectangular blocks of solid aluminum, although any suitable material could be used. The exit sections 118 of the folding rails 20, 22 is machined from square sections at one end of the solid aluminum blocks such that the exit sections 118 have approximately square surfaces 124 and large cut-out sections 126 beneath the approximately square surfaces 124. The approximately square surfaces 124 are horizontal when the folding rails 20. 22 are mounted on riser blocks 16, 18 in use. The cut-out sections 126 below the approximately square surfaces 124 of the exit sections 118 are approximately L-shaped except with rounded corners in order for the exit sections 118 to approximate square horizontal plates attached to the end of the transitional sections 116 of the folding rails 20, 22. The rounded L-shaped cut outs 126 of the exit sections 118 are necessary to accommodate the upward movement of the flaps on the transitional sections 116 so the flaps will avoid contact with the opposing folding rail.

The transitional sections 116 of the folding rails 20, 22 are machined to have rectangular back surfaces 128, right triangular bottom surfaces 130, right triangular side surfaces 132, and curvilinear surfaces 134. The rectangular back surfaces 128 are vertical and the triangular bottom surfaces 130 are horizontal when the folding rails 20, 22 are mounted on riser blocks 16, 18 in use. The triangular side surfaces 132 are vertical but inclined at an angle back from the longitudinal axes of the folding rails 20, 22 when the folding rails 20, 22 are mounted on riser blocks 16, 18 in use.

The curvilinear surfaces 134 are characterized by having a shape approximating the shape attained by twisting a rectangle with horizontal long side walls and vertical short side walls which is contained in a vertical plane through a 90 degree angle so that one vertical short dimension side wall remains in a vertical plane and another vertical short dimension side wall becoming contained in a horizontal plane after twisting.

The shape of the curvilinear surfaces 134 of the folding rails 20, 22 are determined by using three-dimensional modeling on a computer-aided design system in order to machine the transitional and exit sections 118 of the folding rails 20, 22 on a computer numerically controlled machine center using data generated directly from the three-dimensional model.

After the folding rails 20, 22 are machined, the curvilinear surfaces 134 are highly polished in order to protect the cartons from abrasion, scuffing, and for better sliding of the cartons on the folding rails 20, 22.

Furthermore, folding rails 20, 22 have been contemplated in standard 2-inch, 2.812-inch, and 3.75-inch folding surface widths in order to accommodate most carton sizes, widths and flap types, i.e., full-size versus shied. However, folding rails of any suitable folding surface width can be used.

Folding rails 20, 22 are mounted on the riser blocks 16, 18 via all-thread screw 56 and threaded aperture 58 arrangements such that the longitudinal axes of the folding rails 20, 22 are approximately horizontal, parallel and level when the folding rails 20, 22 are mounted on the riser blocks 16, 18 in use. The folding rails 20, 22 are positioned in opposed and offsetting relationship such that a leading folding rail 20 is constructed and arranged to receive a carton, having unfolded, horizontal, glued inner and outer major flaps from a conveyor in order to fold the inner major flap from a vertical orientation to a horizontal orientation, thereby sealing the glued inner major flap to the already folded minor flaps.

A trailing folding rail 22 is constructed and arranged to receive the carton from the first folding rail 12 in order to fold the outer major flap from a vertical to a horizontal orientation, thereby sealing the glued outer major flap to the folded and sealed inner major flap.

The leading folding rail 20 has a nose extension 136 attached to the back of the exit section of the folding rail 20. The nose extension 136 is a flat metal plate having an upper surface 138 which is horizontal when mounted in use behind the folding rail 20 in the flap closure station 12. The upper surface 138 of the nose extension 136 has a straight edge 140 at the front of the nose extension 136. The front end straight edge 140 is of the same dimension as the back edge of the approximately square horizontal surface of the exit section 118 of the folding rail 20. The upper surface 138 of the nose extension 136 has a second straight edge 142 at a side of the nose extension 136 with the second straight edge 142 being of a longer dimension the nose extension's front straight edge 140. The upper surface 138 of the nose extension 136 has a partial U-shaped curved edge 144 extending from the front straight edge 140 of the nose extension 136 to the side straight edge 142 of the nose extension 136 so that the nose extension 136 has a shape resembling one-half of a typical paint brush handle.

The front of the nose extension 136 has a metal attachment forming a ledge 146 in order for the back of the exit section 118 of the folding rail 20 to rest on the ledge 146 of the nose extension 136 and be attached via socket-head cap screws. The nose extension 136 acts to keep the inner major flap in a horizontal position as the outer major flap is being folded from vertical to horizontal on the trailing folding rail 22.

The folding rails 20, 22 are mounted on riser blocks 16, 18 in such a way that the vertical edges 122 connecting the vertical surfaces 120 of the entry sections 114 to the curvilinear surfaces 134 of the transitional sections 116 of each of the folding rails 20, 22 are oriented inwardly to face each other and so that the back edge of the folding rail's triangular bottom surfaces 130 are coextensive with the back edge of the mounting block's top surfaces 44 and portions of the folding rail's bottom surfaces 130 rest entirely on the mounting block's top surfaces 44. The leading folding rail 20 is mounted on the first mounting block 16 so as to be forward of the trailing folding rail 22 mounted on the second mounting block 18 in order to contact and fold the inner major flap of a carton before the carton encounters the trailing folding rail.

Guide rails 24, 26 are mounted to flats machined at the top edge of the rectangular back surfaces 128 of each folding rail 20, 22. The guide rails 24, 26 act to guide the folded edges of the carton near the cartons scoreline through the transitional and exit sections 116, 118 of the folding rails 20, 22 and onto the compression finger assembly 28. The guide rails 24, 26 include long metal bars 148 of rectangular cross-section which taper to a partially rounded blunt end at the leading end of the guide rails where the guide rails 24, 26 initially contact the cartons. The guide rails 24, 26 also include rectangular metal attachment plates 150 of shorter length than the bars 148. The metal attachment plates 150 have at least two holes 152 drilled through their thickness to attach the attachment plates 150 to the rectangular back surfaces 128 of the folding rails 20, 22 via socket-head cap screws in order for the guide rails 24, 26 to sit on top of the flats machined on the folding rails 20, 22.

A compression finger assembly 28 is mounted directly behind and in contact with the folding rail 22 in order for cartons to be guided from the exit section 118 of folding rail 22 by the guide rails 24, 26 onto the compression fingers 154 of the compression finger assembly 28. The compression finger assembly 28 includes a rectangular housing 156, compression fingers 154, two shafts 158, washers 68 and ball plunger units 160.

The housing 156 is generally rectangular in shape having rectangular metal side walls 162 connected to rectangular metal front and back walls 164, 168 and a rectangular metal bottom wall 170. The rectangular metal front and back walls 164, 168 are shorter than the rectangular metal side walls 162. The rectangular bottom wall 170 has a small rectangular shaped cut out 172 at the front of the housing 156 and a larger square shaped cut out 174 at the back of the housing 156 so that the bottom wall 170 of the housing 156 includes only of a rectangular metal edge 176 around the periphery of the bottom wall 170 and a rectangular metal strip 178 located between the cut-outs 172, 174 and extending from one side wall 162 of the housing to the other side wall 162 of the housing 156. Thus, the bottom wall 170 of the housing 156 is mostly open to allow for easy access to the compression fingers 154 for repair purposes or otherwise.

The metal strip 178 between the cut-outs 172, 174 in the bottom wall 170 of the housing 156 has a series of threaded apertures 180 drilled through the strip's thickness for insertion of a threaded end of a ball plunger unit 160. The ball plunger unit 160 includes a ball plunger housing 182 which houses a spring 184 attached to a plunger 186 on the top side of the ball plunger housing 182.

In the preferred embodiment, the housing 156 is constructed and arranged to house between 8 to 12 compression fingers 154, although any number of compression fingers 154 may be used. The compression fingers 154 include a metal rail 188 of generally rectangular cross-section but having a dovetailed triangular-shaped male extension 190 on the top side of the metal rail 188 and two small female grooves 194 of rectangular cross-section in the top side surface 192 of the metal rail 188 on either side of the dovetailed triangular male extension 190. The dovetailed triangular male extension 190 and the female grooves 194 are for mating with a bottom side 196 of a teflon rail 198 which has a triangular shaped female groove 200 in its bottom surface 196 and two rectangular male extensions 202 on either side of the female groove 200 in order for the teflon rail 198 to fit slidingly on top of the metal rail 188.

Compression fingers 154 thus made of slidingly mated metal and teflon rails 188, 198 advantageously cut down on the amount of costly virgin teflon needed to construct the smooth, non-abrasive rails necessary for the cartons to slide along in order to compress the cartons to spread the glue and also advantageously provide for quick and easy replacement of the teflon rails 198 due to wear or glue build-up without the necessity of disassembling the compression rail assembly 28.

The use of the rectangular shaped male and female members 202, 194 is needed only for the teflon rails 198 of the compression fingers 154 because the temperature of the cartons from the hot glue is such that expansion of the teflon rails 198 could occur. Thus, the rectangular male and female members 202, 194 on either side of the dovetailed male and female member 190, 200 prevent spreading out of the teflon rails 198 in order to maintain a uniform fit. The rectangular male and female members 202, 194 are unnecessary with respect to the teflon rails 198 of the transport rail assembly 30 because of the lower temperature of the cartons at the transport rail assembly 30 and the longer length of the transport rails 204 within the transport rail assembly 30.

The metal rails 188 of the compression fingers 154 further have a partial U-shaped cut-out 206 at their back ends and circular apertures 208 drilled through their width at their front end and near the cut-outs 206 in their back end. The partial U-shaped cut-outs 206 in the metal rails 188 are necessary in order for the compression fingers 154, originally canted upwardly, to be moved like piano keys within the housing 156 to a horizontal orientation. Without the end cut-outs 206 the compression fingers 154 could not rotate through as full a range of motion. The circular apertures 210 at the front and near the back of the metal rails of the compression fingers 154 are for insertion of a metal shaft 212 in order to connect the compression fingers 154 together. A washer 68 is placed between each compression finger 154 on the shaft 212 in order to separate the compression fingers 154 to aid in the individual movement of the compression fingers 154.

The compression finger assembly 28 is assembled by drilling apertures 210 in the side walls 162 of the housing 156 near the front of the housing 156 and at a distance from the rear of the housing 156 correspondingly slightly greater than the length of the partial U-shaped cut-outs 206 in the metal rails 188 of the compression fingers 154. The compression fingers 154 are arranged side by side in the housing 156 such that the front edges of the metal rails 188 of the compression fingers 154 are coextensively aligned with the front edge of the front wall 164 of the housing 156 in order for the compression fingers 154 to rest on the front wall 164 of the housing 156. The back edges of the compression fingers 154 are coextensively aligned with the back edge of the back wall 168 of the housing 156, but the compression fingers 154 are canted upwards so as not to rest on the back wall 168 of the housing 156. The ball plunger units 160 extend vertically upward from their attachment to the housing's bottom wall metal strip 178 to contact the bottom of the metal rails 188 of the compression fingers 154 to cant the compression fingers 154 so that the back end of the top surface of the teflon rails 198 of the compression fingers 154 is above horizontal. The compression fingers 154 are connected to the housing 156 and each other via metal shafts 212 inserted through the front and back apertures 208 drilled in the side walls 162 of the housing 156 with each compression finger 154 being separated by a washer 68. Each end of each shaft 212 receives a washer 68 and a nut 60 in order to secure the compression fingers 154 in the housing 156. In this way, each compression finger 154 may be compressed individually like a piano key by putting a downward pressure or force on the compression finger 154 to thereby depress the plunger 186 and the spring 184 of the ball plunger unit 160 until the compression finger 154 reaches a horizontal orientation at which point its rotation further downward is restricted by contact of the upper surface of the cut-out section 206 of the metal rail 188 of the compression finger 154 with the upper surface of the back wall 168 of the housing. When the downward pressure or force on the compression finger 154 is released the plunger 186 and the spring 184 of the ball plunger unit 160 return to their normally extended position to cause the compression fingers 154 to snap back up to their normally canted position.

The compression finger assembly 154 is mounted on L-shaped brackets 214 in order for the top of the teflon rails 198 at the front end of the compression finger assembly 28 to be at the same level or slightly lower than the level of the horizontal surface 124 of the exit section 118 of the trailing folding rail 22. The L-shaped brackets 214 are attached to the compression finger housing 156 and the base 14 of the flap closure station 12 via socket-head cap screws.

The transport rail assembly 30 includes a set of slidingly matable metal and teflon transport rails 226 similar to the rails 198 of the compression finger assembly 28, except that the metal and teflon rails 188, 198 of the transport rail assembly 30 do not have the rectangular male and female members 202, 194 located on either side of the dovetailed male and female members 190, 200. The transport rail assembly 30 also includes a mounting attachment 216 machined from a rectangular block of aluminum to have a main rectangular plate section 218 from which extends two rectangular legs 220 on one side of the plate 218 and numerous rectangular walls 222 on the other side of the plate 218. Between the numerous rectangular walls 222 are rectangular shaped grooves 224 of a size to house a metal rail 188 of a transport rail 226. The mounting attachments 216 are designed to house 8 or 12 transport rails 226, however, an attachment 216 for any number of rails 226 could be used.

The legs 220 of the mounting attachments 216 have apertures 228 through their thickness in order to insert shafts 230 of aircraft-type pins 232 such that a bulb 234 at the end of the shaft 230 is released upon the release of a pushed button 236 in order to keep the shaft 230 of the pin 232 from being withdrawn through the apertures 228 until the button 236 is again pushed in. In this manner, the mounting attachment 216 may be fastened to a mounting block secured to the surface on which the transport rail assembly is to be mounted and having apertures through which the shaft of the aircraft-type pin may be inserted.

The mounting attachment 216 also has apertures 228 through the thickness of the main plate 218 an leading into the rectangular grooves 224 formed between the rectangular walls 222. The apertures 228 are for insertion of a screw for threading into an aperture 228 in the bottom of the metal rail 188 of the transport rails 226. In the preferred embodiment, two mounting attachments 216 are so attached at each end of a 48-inch section of transport rail assembly 30. A third attachment 240, similar to the mounting attachments 216 except not having legs 220, may also be attached at a center of the 48-inch section of the transport rail assembly 30 so as to provide added support.

The transport rail assembly 30 is mounted on top of an adjustable height pillar block assembly of the packaging operation as is the base 14 of the flap closure station 12 in order for the height of the folding rails 20, 22, compression finger assemblies 28 and transport rail assemblies 30 to be easily adjustable.

In operation, a top and bottom flap closure station are each arranged along a straight section of a racetrack oval-shaped conveyor arrangement in a typical packaging operation. The packaging operation begins with a carton conveyor arrangement in a typical packaging operation. The packaging operation begins with a carton conveyor feeding upside down, backside forward, flatly folded cartons into a carton pick-off area usually located along the front curved section of the oval conveyor arrangement.

The pick off area uses a suction cup type arrangement to pick off a flatly folded carton from the stack with vacuum which once applied, opens the flatly folded carton into a rectangular tube. The rectangular carton tube is mechanically fitted in between pockets bolted on to a conveyor belt and a slight downward pressure is applied to the carton flaps in order to keep the carton in place as it is transported around the oval conveyor arrangement.

The rectangular carton tube is conveyed passed curved pie slice shaped island or ramps which spread open the major flaps on the bottom of the inverted carton in order for the major flaps to be horizontally oriented but does not interfere with the minor flaps.

The carton tube is then conveyed to a station where a tucker wheel plows the front minor flap to fold the front minor flap up from a vertical orientation to a horizontal orientation and into the opening of the carton tube. A notch in the tucker wheel then plows the back minor flap to fold the back minor flap up from a vertical orientation to a horizontal orientation and into the opening of the carton tube.

The carton tube is then conveyed to a gluing station where an electronically timed glue head with a blade as wide as the carton flap applies glue beads t o the carton flaps at the bottom of the inverted carton in a predetermined pattern. As the carton tube is transported from the gluing station to the flap closure station 12, the rod of the glue head holds the minor flaps horizontally and at the same time the major flaps are allowed to drop to a 45° angle.

When the carton tube arrives at the top flap closure station 12, the inner major flap of the inverted carton tube contacts the entry section 114 of the leading folding rail 20 to move the inner major flap from a 45° angle to a vertical orientation. As the carton moves forward into the flap closure station 12, the inner major flap is transported over the curvilinear surface 134 of the leading folding rail 20 to fold the inner major flap from a vertical orientation to a horizontal orientation and to square the carton. As the inner major flap is moving up from vertical to horizontal, the scoreline of the inner major flap is being guided by the guide rail 24 resting on the top flat of the leading folding rail 20 and attached to the rectangular back surface 128 of the leading folding rail 20 to keep the carton in true square.

As the inner major flap begins sliding onto the horizontal exit section 118 of the leading folding rail 20 and continues onto the nose extension 136, the outer major flap begins to contact the entry section 114 of the trailing folding rail 22 to move the outer major flap from a 45° angle to a vertical orientation. As the carton continues moving forward into the flap closure station 12, the outer major flap is transported over the curvilinear surface 134 of the trailing folding rail 22 to fold the outer major flap from a vertical orientation to a horizontal orientation and to square the carton. The movement upward of the outer major flap from vertical to horizontal would be interfered with by the outer major flap hitting the leading folding rail 20 below the horizontal surface 124 of the leading folding rail's exit section 118 if it were not for the cut-out area 128 beneath the exit section 118 of the leading folding rail 20.

The carton continues forward into the flap closure station 12 and the outer major flap contacts the horizontal exit section 118 of the trailing folding rail 22. The carton is contacted at the scorelines of both inner and outer major flaps by the guide rails 24, 26 to the compression finger assembly 28.

The carton contacts the compression fingers 154 which are canted upwardly. The downward pressure on the carton is slightly increased as the carton slides across the compression fingers 154 in order compress the compression fingers 154 at the end of the compression finger 154 assembly like piano keys. The compression of the carton on the compression fingers 154 wipes or spreads out the glue on the flaps to allow for a more secure attachment of the carton flaps to each other. As the carton leaves the compression finger assembly 28, the compression fingers 154 are fully compressed from a canted to a horizontal orientation for sliding of the carton onto the transport rails 226 positioned at the same level as the folly compressed compression fingers 154. The compression fingers 154 snap back up to a canted position as the carton move fully onto the transport rails 226.

The carton continues along the transport rails 226 for the remainder of the straightaway section of the oval conveyor arrangement in order to further spread the glue, allow the carton to set and have a plastic scoop dropped into the now partially closed carton.

As the carton moves from the transport rails 226 into the filler station a rod protrudes and hits the inside major flat a the top of the inverted carton to push the flap down to a horizontal orientation in order for filter funnel to be introduced in a circular fashion into the opening at the top of the carton. The carton is filled and vibrated around the 180° curved end section of the oval conveyor arrangement until it arrives at t he second straightaway section of the oval conveyor arrangement.

When the carton moves through the second straightaway section, the carton encounters the same tucker wheel, glue head, flap closure, compression finger and transport rail apparatus as in the first straightaway section of the oval conveyor arrangement except that much of the apparatus is hung inverted from supports in order to contact the top of the loaded carton to close the carton.

As the carton moves off the transport rails 226 of the second straightaway section of the oval conveyor arrangement, the cartons pass a six foot dryer section of the conveyor belt before moving off the racetrack oval into the case packer.

Although the invention has been described in detail for the purpose of illustration, it is to be understood that such detail is solely for that purpose and that variations can be made therein by those skilled in the art without deporting from the spirit and scope of the invention except as it may be limited by the claims.

I claim:

1. In a packaging apparatus for folding and sealing cartons which are supplied upside-down and initially flat and which have four side wall panels forming a rectangular tube and a top and bottom pair of minor and inner and outer major closure flaps hinged to a top and bottom end of each side wall panel and applied with glue prior to folding, a first conveyor section for supporting and transporting a plurality of unloaded cartons to a top flap closure station, and a second conveyor section for supporting and transporting a plurality of loaded cartons to a bottom flap closure station wherein said top flap closure station and said bottom flap closure station each comprise:

a base having a length, width and thickness:

a first and second mounting block wherein said first mounting block is stationarily mounted to said base at a front end of said base and said second mounting block is translatably mounted to said base at a location behind said first mounting block so as to be capable of being locked into a position at various locations along said width of said base; and a first and second folding rail positioned in opposed and offsetting relation to each other such that said first folding rail is a leading folding rail mounted on said first stationary mounting block for folding and consistently squaring said inner major flap at an end of said carton in order to seal said inner major flap to previously tucked said minor flaps and said second folding rail is a trailing folding rail mounted on said second translatable mounting block for folding and consistently squaring said outer major flap at a same said end of said carton in order to seal said outer major flap to said inner major flap and wherein said folding rails have longitudinal axes that are approximately horizontal, parallel and level when said folding rails are mounted on said mounting blocks in use in said packaging operation such that said longitudinal axes of said folding rails may be moved closer together or farther apart by translation of said trailing folding rail on said second translatable mounting block in order to quickly and easily fold different width cartons.

2. The apparatus as in claim 1 wherein said folding rails each have a first, second and third portion such that said first portion has an approximately vertical surface, said third portion has an approximately horizontal surface, and said second portion is an intermediate portion between said first and third portion having a curvilinear surface connecting said vertical surface of said first portion to said horizontal surface of said third portion.

3. The apparatus as in claim 2 wherein said curvilinear surface is characterized by having a shape approximating a shape attained by twisting a rectangular surface contained in vertical plane and having horizontal long side walls and vertical short side walls through a 90° angle so that one short vertical side wall remains in said vertical plane and another short vertical side wall becomes contained in a horizontal plane after twisting.

4. The apparatus as in claim 3 wherein said curvilinear surface is highly polished to allow for better sliding of said cartons on said curvilinear surface.

5. The apparatus as in claim 4 wherein said first portion is a rectangular plate having an approximately vertical surface and an approximately vertical edge at an intersection of said first and second portions and wherein said vertical surface is not coextensive with said longitudinal axis but is angled back from said longitudinal axis of said folding rail in order to guide said major flaps of said carton from an approximately 45° angle to an approximately vertical orientation.

6. The apparatus as in claim 5 further comprising a nose extension attached to a back end of said third portion via a ledge at a front end of said nose extension such that said nose extension having a horizontal surface with a cut-out section is positioned so that said horizontal surface of said nose extension is level with said approximately horizontal surface of said third section in order for said nose extension to support said inner major flap in a folded, horizontal orientation as said outer major flap rises from vertical to horizontal on said trailing folding rail and wherein said cut-out section of said nose extension provides clearance for said rise of said outer major flap on said trailing folding rail by preventing interference of said outer major flap with said nose extension.

7. The apparatus as in claim 6 further comprising guide rails wherein said guide rails are metal bars of square cross section mounted on said folding rails for guiding said cartons over said curvilinear and horizontal surfaces of said folding rails to a compression finger assembly.

8. The apparatus as in claim 7 wherein said compression finger assembly comprises:

a housing; and a plurality of compression fingers wherein each said compression finger includes a metal rail portion which slidingly mates with a teflon rail portion via dovetail-shaped male member extending from a top surface of said metal rail and a dovetail-shaped female member through a bottom surface of said teflon rail and wherein said plurality of compression fingers are housed in said housing on shafts through apertures in side walls of said housing and through apertures in said metal rails such that said compression fingers are positioned on top of spring and plunger units in order for a back end of each compression finger to be canted upwardly so that the compression fingers may function like piano keys to compress said cartons after folding and thereby spread the glue.

9. The apparatus as in claim 8 further comprising two rectangular male members extending from said bottom surface of said teflon rail on either side of said dovetail-shaped female member and two rectangular female members through said top surface of said metal rail on either side of said dovetail-shaped male member wherein said rectangular male and female members slidingly mate with each other to prevent spreading out of said teflon rails in order to maintain a uniform fit.

10. The apparatus as in claim 9 further comprising cut-outs in said back ends of said metal rail of said compression fingers which are canted upwardly above horizontal such that said cut-outs allow for a greater range of motion of said compression fingers in order for said compression fingers to be compressed to a horizontal orientation when downward pressure is applied to said cartons as said cartons slide across said smooth, nonabrasive teflon rails of said compression fingers.

11. The apparatus as in claim 10 further comprising a transport rail assembly including a mounting attachment and a plurality of transport rails wherein said transport rails have metal rail portions which slidingly mate with teflon rail portions via dovetail-shaped male members extending from top surfaces of said metal rails and dovetail-shaped female members through bottom surfaces of said teflon rails for quick and easy replacement of said teflon rails as said teflon rails become worn or built-up with glue.

12. The apparatus as in claim 11 wherein said transport rail assembly is positioned directly behind said compression rail assembly at a height corresponding to said horizontal orientation of said compression fingers when compressed in order for said cartons to slide on said smooth, nonabrasive teflon rails of said transport rails to allow said cartons to set.

13. The apparatus as in claim 12 wherein said folding rails are made in a plurality of sizes having different folding surface widths for folding cartons within different size ranges.

14. The apparatus as in claim 13 further comprising a universal bracket in order to quickly and easily change said folding rails at a flap closure station to said folding rails of different size folding surface widths.

15. The apparatus as in claim 14 wherein said universal bracket comprises a large and small rectangular plate, weld to each other along a welded edge to form an L-shaped bracket, a pair of cylindrical shafts each welded to a corner of said large plate opposite said welded edge so that said shafts and plates form a U-shaped configuration, and a pair of supports sized to fit between a bottom surface of said small plate and a top rounded surface of said shafts in order for said supports to be welded between said small plate and said shaft.

16. The apparatus as in claim 15 wherein said universal bracket is mounted to a support structure in a packaging operation such that said shafts are transverse to a direction of travel of said cartons for insertion of said shafts in apertures through said mounting block in order to quickly and easily changeover said folding rails.

17. In a packaging apparatus for folding and sealing cartons which are supplied upside-down and initially flat and which have four side wall panels and a top and bottom pair of minor and overlapping major closure flaps which are hinged to a top and bottom end of each side wall panel and applied with glue prior to folding, a first conveyor section for supporting and transporting a plurality of unloaded cartons to a top flap closure station, and a second conveyor section for supporting and transporting a plurality of loaded cartons to a bottom flap closure station wherein said top flap closure station and said bottom flap closure station each comprise:

a base;

a first and second mounting block for mounting to said base; and a first and second folding rail positioned in opposed and offsetting relation to each other such that said first folding rail is a leading folding rail mounted on said first mounting block at a front end of said base for folding and consistently squaring said inner major flap at one end of said carton in order to seal said inner major flap to previously folded minor flaps and said second folding rail is a trailing folding rail mounted on said second mounting block at a position offsettingly behind said leading folding rail for folding and consistently squaring a glued, overlapping, outer major flap at said one end of said carton in order to seal said overlapping, outer major flap to said inner major flap and wherein said folding rails each have a first, second and third portion, said first portion having an approximately vertical surface connected to said second portion at an approximately vertical edge, said second and third portions being machined from a solid block of metal so that said second portion has a curvilinear surface and said third portion has an approximately horizontal surface connected to said curvilinear surface of said second portion at an approximately horizontal edge.

18. The apparatus as in claim 17 wherein said curvilinear surface is characterized by having a shape approximating a shape attained by twisting a rectangular surface contained in a vertical plane and having horizontal long side walls and vertical short side walls through a 90° angle so that one short vertical side wall remains in said vertical plane and another short vertical side wall becomes contained in a horizontal plane after twisting.

19. The apparatus as in claim 18 wherein said curvilinear surface is highly polished to allow for better sliding of said cartons on said curvilinear surface.

20. The apparatus as in claim 19 wherein said approximately vertical surface of said first portion of said folding rail is not coextensive with said longitudinal axis of said folding rail but is angled back from said longitudinal axis of said folding rail in order to guide said major flaps of said carton from an approximately 45° angle to an approximately vertical orientation.

21. The apparatus as in claim 20 further comprising a nose extension attached to a back end of said third portion via a ledge at a front end of said nose extensions such that said nose extension having a horizontal surface with a cut-out section is positioned so that said horizontal surface of said nose extension is level with said approximately horizontal surface of said third section in order for said nose extension to support said inner major flap in a folded, horizontal orientation as said outer major flap rises from vertical to horizontal on said trailing folding rail and wherein said cut-out section of said nose extension provides clearance for said rise of said outer major flap on said trailing folding rail by preventing interference of said outer major flap with said nose extension.

22. The apparatus as in claim 21 further comprising guide rails wherein said guide rails are metal bars of square cross section mounted on said folding rails for guiding said cartons over said curvilinear and horizontal surfaces of said folding rails to a compression finger assembly.

23. The apparatus as in claim 22 wherein said compression finger assembly comprises:

a housing; and a plurality of compression fingers wherein each said compression finger includes a metal rail portion which slidingly mates with a teflon rail portion via a dovetail-shaped male member extending from a top surface of said metal rail and a dovetail-shaped female member through a bottom surface of said teflon rail and wherein said plurality of compression fingers are housed in said housing on shafts through apertures in side walls of said housing and through apertures in said metal rails such that said compression fingers are positioned on top of spring and plunger units in order for a back end of each compression finger to be canted upwardly so that the compression fingers may function like piano keys to compress said cartons after folding and thereby spread the glue.

24. The apparatus as in claim 23 further comprising two rectangular male members extending from said bottom surface of said teflon rail on either side of said dovetail-shaped female member and two rectangular female members through said top surface of said metal rail on either side of said dovetail-shaped male member wherein said rectangular male and female members slidingly mate with each other to prevent spreading out of said teflon rails in order to maintain a uniform fit.

25. The apparatus as in claim 24 further comprising cut-outs in said back ends of said metal rail of said compression fingers which are canted upwardly above horizontal such that said cut-outs allow for a greater range of motion of said compression fingers in order for said compression fingers to be compressed to a horizontal orientation when downward pressure is applied to said cartons as said cartons slide across said smooth, non-abrasive teflon rails of said compression fingers.

26. The apparatus as in claim 25 further comprising a transport rail assembly including a mounting attachment and a plurality of transport rails wherein said transport rails have metal rail portions which slidingly mate with teflon rail portions via dovetail-shaped male members extending from top surfaces of said metal rails and dovetail-shaped female members through bottom surfaces of said teflon rails for quick and easy replacement of said teflon rails as said teflon rails become worn or built-up with glue.

27. The apparatus as in claim 26 wherein said transport rail assembly is positioned directly behind said compression rail assembly at a height corresponding to said horizontal orientation of said compression fingers when compressed in order for said cartons to slide on said smooth, nonabrasive teflon rails of said transport rails to allow said cartons to set.

28. The apparatus as in claim 27 wherein said folding rails are made in a plurality of sizes having different folding surface widths for folding cartons within different size ranges.

29. The apparatus as in claim 28 further comprising a universal bracket in order to quickly and easily change said folding rails at a flap closure station to said folding rails of different size folding surface widths.

30. The apparatus as in claim 29 wherein said universal bracket comprises a large and small rectangular plate, weld to each other along a welded edge to form an L-shaped bracket, a pair of cylindrical shafts each welded to a corner of said large plate opposite said welded edge so that said shafts and plates form a U-shaped configuration, and a pair of supports sized to fit between a bottom surface of said small plate and a top rounded surface of said shafts in order for said supports to be welded between said small plate and said shaft.

31. The apparatus as in claim 30 wherein said universal bracket is mounted to a support structure in a packaging operation such that said shafts are transverse to a direction of travel of said cartons for insertion of said shafts in apertures through said mounting block in order to quickly and easily changeover said folding rails.

32. A method for folding and consistently squaring cartons having four side wall panels forming a rectangular tube and a top and bottom pair of minor and overlapping major closure flaps hinged to a top and bottom end of each side wall panel, comprising the method steps of:

providing an apparatus for folding cartons to consistently square said cartons wherein said apparatus includes a leading folding rail and a trailing folding rail mounted on mounting blocks when in use in a packaging operation, each of said folding rails having a first, second and third portion wherein said first portion has an approximately flat vertical surface connected to said second portion at an approximately vertical edge, said third portion has an approximately flat horizontal top surface connected to said second portion at an approximately horizontal edge, and said second portion has a curvilinear portion connecting said vertical surface of said first portion to said horizontal surface of said third portion;

transporting a carton on a conveyor to a flap closure station; and moving said cartons through said flap closure station to contact said vertical, curvilinear and horizontal surfaces of said first, second and third portions, respectively, of said leading and trailing folding rails to fold said overlapping major flaps of said carton from a vertical orientation to a horizontal orientation and more consistently square said carton.

* * * * *